US009905970B2

(12) United States Patent
Sone et al.

(10) Patent No.: US 9,905,970 B2
(45) Date of Patent: Feb. 27, 2018

(54) CONNECTOR WITH MOUNTING MEMBER THAT RESTRICTS REARWARD MOVEMENT OF CONNECTOR UNTIL CONNECTOR IS CONNECTED PROPERLY TO MATING CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kosuke Sone, Mie (JP); Tetsuji Tanaka, Mie (JP); Hitoshi Takeda, Mie (JP)

(73) Assignees: AUTONETWORKS TECHNOLOGIES, TLD., Yokkaichi, Mie (JP); SUMITOMO WIRING SYSTEMS, LTD., Yokkaichi, Mie (JP); SUMITOMO WIRING INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/514,636

(22) PCT Filed: Oct. 13, 2015

(86) PCT No.: PCT/JP2015/078955
§ 371 (c)(1),
(2) Date: Mar. 27, 2017

(87) PCT Pub. No.: WO2016/060131
PCT Pub. Date: Apr. 21, 2016

(65) Prior Publication Data

US 2017/0229815 A1 Aug. 10, 2017

(30) Foreign Application Priority Data

Oct. 17, 2014 (JP) ..... 2014-212182

(51) Int. Cl.
*H01R 13/60* (2006.01)
*H01R 13/639* (2006.01)
(Continued)

(52) U.S. Cl.
CPC ..... *H01R 13/639* (2013.01); *H01R 13/6272* (2013.01); *H01R 13/64* (2013.01); *H01R 13/642* (2013.01)

(58) Field of Classification Search
CPC ..... H01R 13/73
(Continued)

(56) References Cited

U.S. PATENT DOCUMENTS 5,192,225 A 3/1993 Suzuki
7,338,314 B2 * 3/2008 Thai ..... H01R 43/26 248/51
(Continued)

FOREIGN PATENT DOCUMENTS

| | | |
|---|---|---|
| JP | 4-174983 | 6/1992 |
| JP | 2005-190720 | 7/2005 |
| JP | 2009-4318 | 1/2009 |
| JP | 2014-44825 | 3/2014 |

OTHER PUBLICATIONS

International Search Report dated Nov. 17, 2015.

*Primary Examiner* — Phuong Dinh
(74) *Attorney, Agent, or Firm* — Gerald E. Hespos; Michael J. Porco; Matthew T. Hespos

(57) ABSTRACT

It is aimed to provide a connector capable of reaching a properly connected state while responding to a rotational movement. A connector housing (10) is mounted into a mounting member (16) displaceably to a temporary holding
(Continued)

position and a retracted position, has a rearward movement restricted at the temporary holding position and is released from a holding state at the temporary holding position and moved rearward together with a mating connector housing (11) after being properly connected to the mating connector housing (11). The connector housing (10) is not held by the mounting member (16) at the retracted position and is movable integrally with the mating connector housing (11) according to a movement of the side of the mating connector housing (11).

6 Claims, 14 Drawing Sheets

(51) Int. Cl.
*H01R 13/64* (2006.01)
*H01R 13/642* (2006.01)
*H01R 13/627* (2006.01)

(58) Field of Classification Search
USPC ..... 439/575, 354
See application file for complete search history.

(56) References Cited

U.S. PATENT DOCUMENTS 9,627,824 B2 * 4/2017 Giangrande ..... H01R 13/73
2008/0318458 A1 12/2008 Hiramatsu

* cited by examiner

CONNECTOR WITH MOUNTING MEMBER THAT RESTRICTS REARWARD MOVEMENT OF CONNECTOR UNTIL CONNECTOR IS CONNECTED PROPERLY TO MATING CONNECTOR

BACKGROUND

1. Field of the Invention

The present invention relates to a connector.

2. Description of the Related Art

Japanese Unexamined Patent Publication No. 2005-190720 discloses a self-aligning connector with a plug connector housing to be mounted in a hole of a panel partition wall and a receptacle connector fittable to the plug connector housing. The plug connector housing includes a plurality of resilient engaging portions. The plug connector housing is supported on the panel partition wall swingably in a connecting direction to the receptacle connector housing and within a plane perpendicular to the connecting direction via each resilient engaging portion.

An external force may act on one of the above-described connector housings and may rotate this one connector housing. In this situation, each resilient engaging portion is twisted, and locking between each resilient engaging portion and the panel partition wall may be released inadvertently. A release of the locking between each resilient engaging portion and the panel partition wall can cause the plug connector housing to fall off the panel partition wall and can prevent the connector housings from reaching a properly connected state.

The present invention was completed based on the above situation and aims to provide a connector capable of reaching a properly connected state while responding to a rotational movement.

SUMMARY

The invention is directed to a connector with a connector housing to which a mating connector housing is connectable from the front and a mounting member into which the connector housing is mountable. The connector housing is displaceable with respect to the mounting member between a temporary holding position and a retracted position. The connector housing that is in the temporary holding position is held in the mounting member with a rearward movement restricted. The connector housing can be moved rearward to the retracted position together with the mating connector housing by being released from a holding state at the temporary holding position after the connector housing is connected properly to the mating connector housing. More particularly, the connector housing is movable integrally with the mating connector housing according to a movement of the side of the mating connector housing without being held by the mounting member.

The mounting member restricts a rearward movement of the connector housing when the connector housing is connected to the mating connector housing at the temporary holding position, thereby guaranteeing that both the connector housing and the mating connector housing reach a properly connected state. The connector housing that has reached the retracted position is movable integrally with the mating connector housing according to a movement of the side of the mating connector housing without being held by the mounting member after both connector housings are connected properly. Thus, if the side of the mating connector housing rotates, the connector housing is rotatable together with the mating connector housing according to that rotation.

The mounting member may include a resiliently holding portion configured to hold the connector housing at the temporary holding position displaceably in a direction perpendicular to a front-rear direction. Thus, at the temporary holding position, the connector housing is center-aligned by the resiliently holding portion and concentrically connectable to the mating connector housing.

The mounting member may include a contact stop wall configured to restrict a rearward movement of the connector housing by stopping the connector housing in contact therewith until the connector housing is connected properly to the mating connector housing and to release a contact stop state between the connector housing and the contact stop wall by a rotational operation after the connector housing is connected properly to the mating connector housing. The connector housing is connected properly to the mating connector housing in a state stopped in contact with the contact stop wall at the temporary holding position. The contact stop wall then is rotated so that the contact stop state between the connector housing and the contact stop wall is released and a displacement of the connector housing to the retracted position is enabled. Thus, it can be reliably guaranteed that both connector housings are in a properly connected state when a rotational operation is performed.

The mounting member may include an arm projecting forward. The arm may include a contact stop configured to restrict a rearward movement of the connector housing by stopping the connector housing in contact therewith until the connector housing is properly connected to the mating connector housing. The arm also may include a releasing portion located in front of the contact stop and configured to be pressed by the mating connector housing when the connector housing is connected properly to the mating connector housing, thereby inclining the arm to release a contact stop state between the contact stop and the connector housing. The connector housing is connected properly to the mating connector housing in a state stopped in contact with the contact stop wall at the temporary holding position and, along with that, the releasing portion is pressed by the mating connector housing to incline the arm so that the contact stop state between the connector housing and the contact stop portion is released and a displacement of the connector housing to the retracted position is enabled. Thus, it can be guaranteed that both connector housings are in a properly connected state, and the connector housing can be displaced smoothly from the temporary holding position to the retracted position in linkage with a connecting operation of both connector housings.

DETAILED DESCRIPTION

A first embodiment of the present invention is described with reference to FIGS. 1 to 7. A connector according to the first embodiment is illustrated to be a connector with a self-aligning function used in a control device of an automotive vehicle not shown in detail and includes a connector housing 10 and a mating connector housing 11 connectable to each other. Note that, in the following description, surface sides of the connector housing 10 and the mating connector housings 11 (hereinafter, referred to as both connector housings 10, 11) facing each other at the start of connection are referred to as front sides concerning a front-rear direction. Further, a vertical direction is based on each figure.

Figure 6:
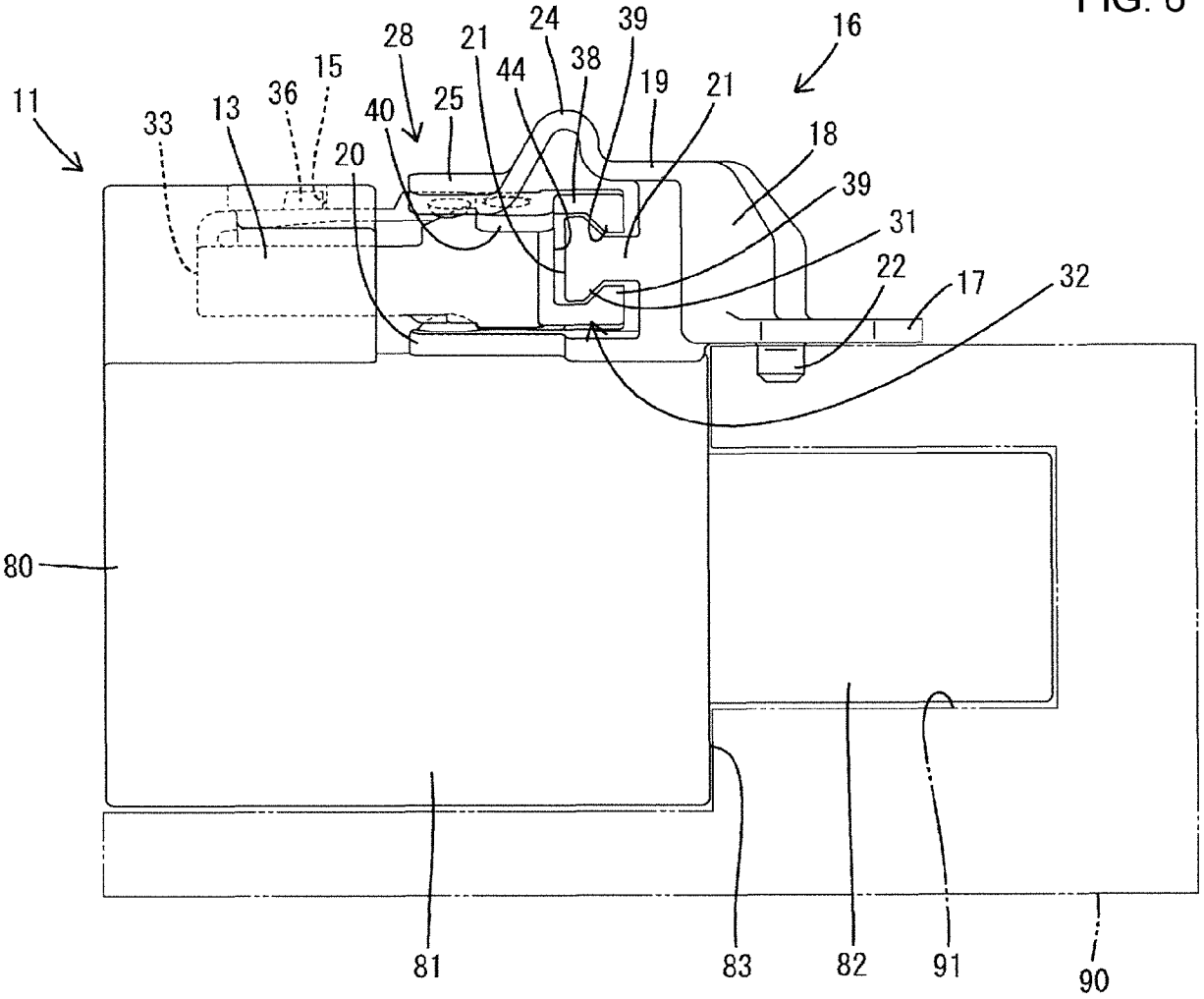
FIG. 6 is a side view showing a state where the connector housing is at a retracted position with respect to the mounting member.

As shown in FIG. 6, the control device includes a valve body 90, and solenoids 80 (only one is shown) are incorporated into the valve body 90. The connector is provided to correspond to each solenoid 80, the mating connector housing 11 is arranged on the side of the solenoid 80 and the connector housing 10 is arranged on the side of the valve body 90. A solenoid mounting portion 91 for mounting the solenoids 80 is fixed in the valve body 90. The solenoid mounting portion 91 has a substantially hollow cylindrical shape projecting from the upper surface of the valve body 90.

Figure 1:
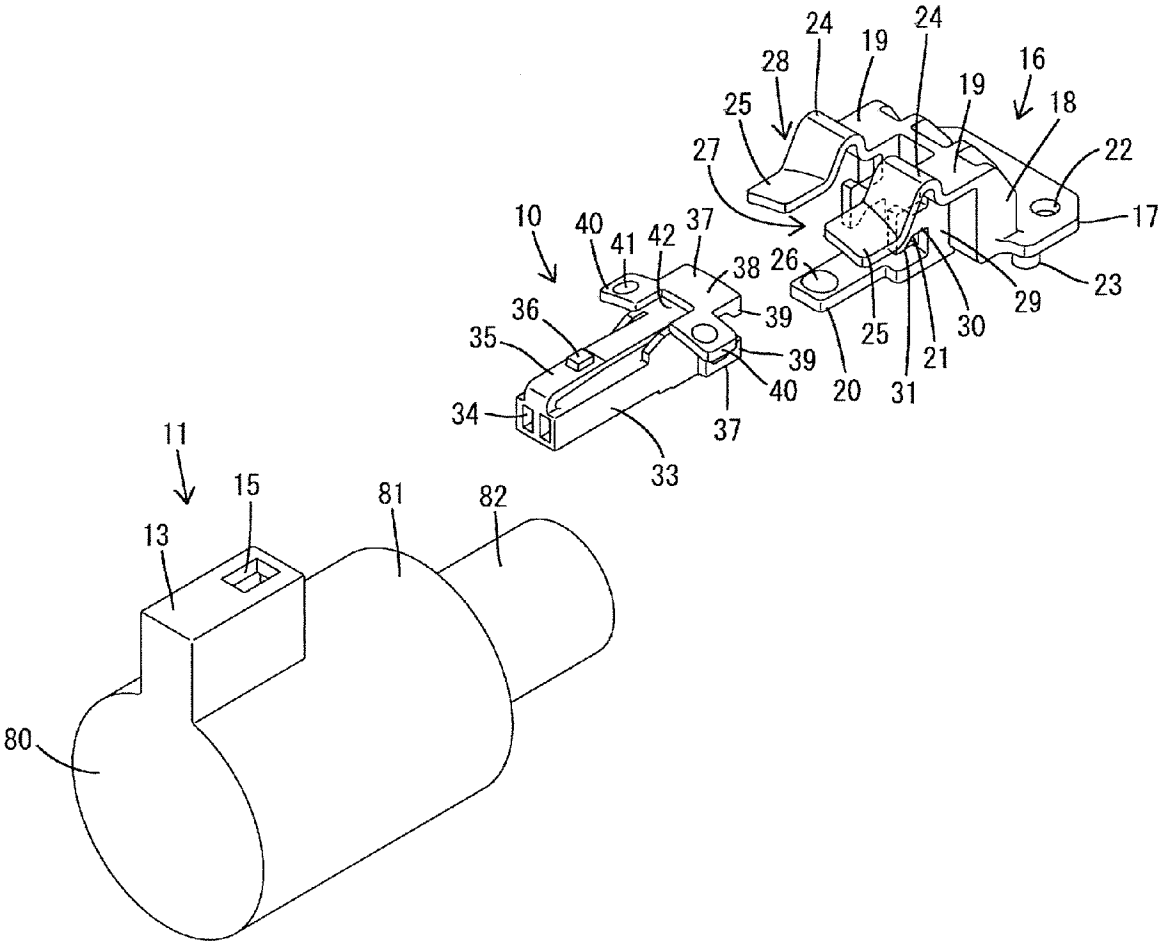
FIG. 1 is perspective view showing a state where a mating connector housing provided on a solenoid, a connector housing and a mounting member are separated in a first embodiment of the present invention.

As shown in FIG. 1, the solenoid 80 has a cylindrical shape and is composed of an electromagnetic portion 81 and a valve portion 82. The valve portion 82 has a smaller diameter than the electromagnetic portion 81 and is insertable into the solenoid mounting portion 91. When the valve portion 82 is inserted properly into the solenoid mounting portion 91, as shown in FIG. 6, a step 83 at a boundary part between the valve portion 82 and the electromagnetic portion 81 contacts the front end surface of the solenoid mounting portion 91 and, in that state, the solenoid 80 is fixed to the valve body 90 via an unillustrated fixing means. A control circuit is configured by inserting the valve portion 82 into the solenoid mounting portion 91.

Figure 3:
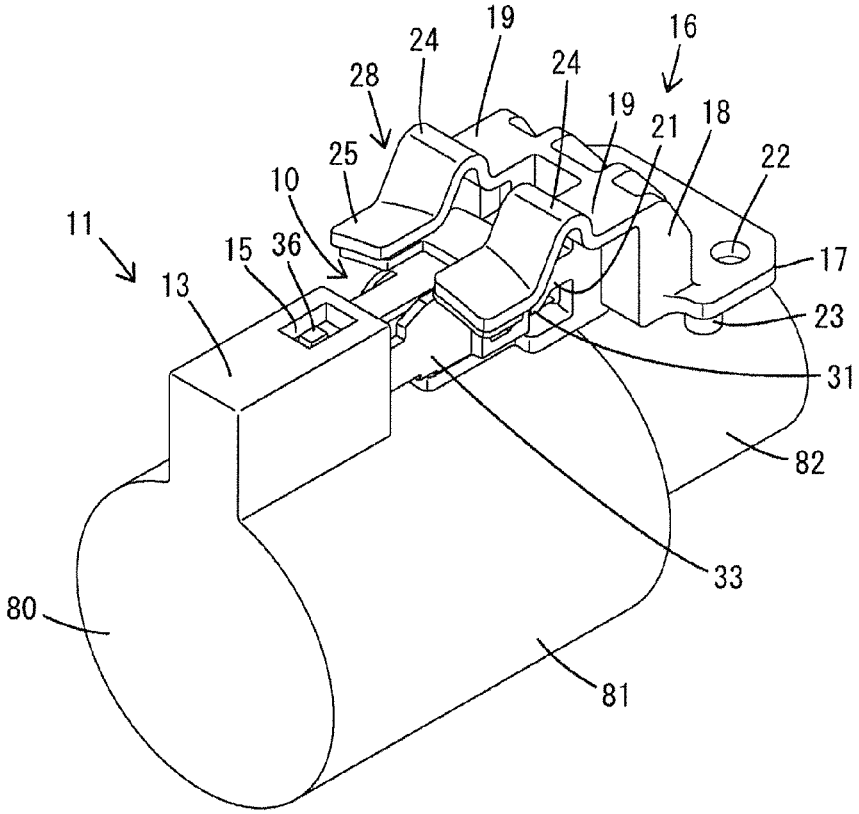
FIG. 3 is a perspective view showing a state where the mating connector housing provided on the solenoid is properly connected to the connector housing.

As shown in FIG. 1, the mating connector housing 11 projects on the outer peripheral surface of the electromagnetic portion 81 of the solenoid 80. The mating connector housing 11 includes a forwardly open tubular receptacle 13. Unillustrated pin-like male terminal fittings connected to the solenoid 80 project into the receptacle 13. A lock hole 15 penetrates through an upper wall of the receptacle 13. The connector housings 10, 11 are held in a connected state by resiliently fitting a later-described lock portion 36 of the connector housing 10 into the lock hole 15, as shown in FIG. 3.

An unillustrated harness accommodating member in the form of a flat case is mounted on the upper surface of the valve body 90. Unillustrated wires pulled out from the connector housing 10 are arranged in the harness accommodating member. A mounting member 16 of the connector is coupled to the harness accommodating member.

The mounting member 16 is made of synthetic resin and, as shown in FIG. 1, composed of a horizontal flat plate 17 extending in a lateral direction (width direction), a rising portion 18 in the form of a vertical wall rising from a front end part of the plate 17, a pair of first resilient pieces 19 cantilevered forward from left and right sides of an upper end part of the rising portion 18, a second resilient piece 20 cantilevered forward from a laterally central part of a lower end part of the rising portion 18 and contact stop walls 21 in the form of plates protruding forward from positions between the first resilient pieces 19 and the second resilient piece 20 on both left and right sides of the rising portion 18 and extending along the vertical direction. The plate 17 is mounted and fixed to the harness accommodating member via holes 22 and bosses 23.

Figure 4:
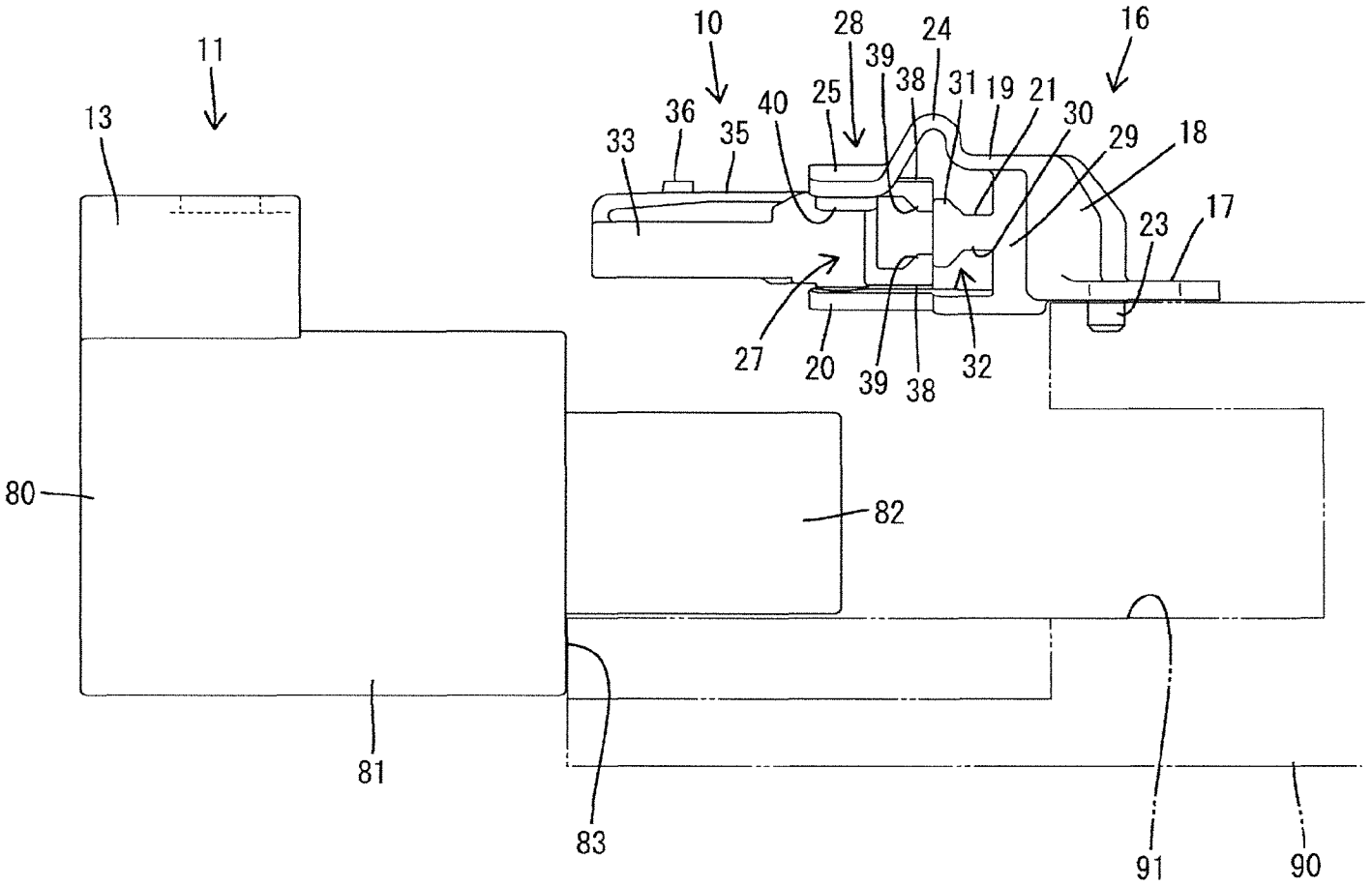
FIG. 4 is a side view corresponding to the state of FIG. 2.
Figure 7:
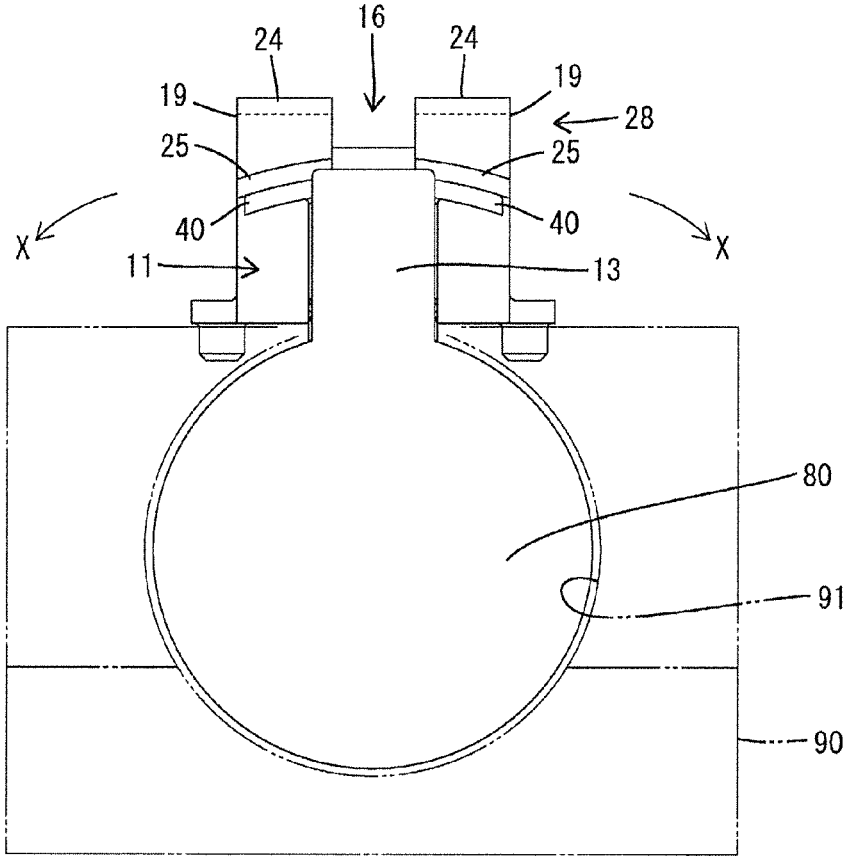
FIG. 7 is a front view showing a state where the both connector housings are properly connected when viewed from the side of the mating connector housing.

Each of the first resilient pieces 19 and the second resilient piece 20 is in the form of a plate having a substantially constant width in the lateral direction. The first resilient pieces 19 include curved portions 24 located at an intermediate position in the front-rear direction and convexly curved to project up in a side view, as shown in FIG. 4, and contact portions 25 inclined down from a laterally central side toward opposite sides in a front view, as shown in FIG. 7. The contact portions 25 of the first resilient pieces 19 extend along concentric arc virtual lines centered on an axial center of the solenoid 80 when the connector housings 10, 11 are connected. A convex spherical projection (similar to a later-described projection 26 of the second resilient piece 20 shown in FIG. 1 although not shown here) projects on the lower surface (inner surface) of the contact portion 25.

The second resilient piece 20 is a long plate extending substantially horizontally in the front-rear direction and has a smaller width than the first resilient pieces 19 in the lateral direction, and the front end thereof is located substantially at the same position as the front ends of the first resilient pieces 19 in the front-rear direction as shown in FIG. 4. As shown in FIG. 1, the projection 26 projects on the upper surface (inner surface) of the second resilient piece 20 similarly to the first resilient pieces 19.

As shown in FIG. 4, the mounting member 16 is formed with an open holding space 27 between the first resilient pieces 19 and the second resilient piece 20 and in front of the front end of the contact stop walls 21. The connector housing 10 resiliently supported by the first resilient pieces 19 and the second resilient piece 20 is accommodated displaceably into the holding space 27. Note that the first resilient pieces 19 and the second resilient piece 20 collectively are called as a resiliently holding portion 28 below.

As shown in FIG. 4, each contact stop wall 21 is composed of a base plate 29 extending along the vertical direction and coupled to both left and right side parts of the rising portion 18, a projection 30 projecting forward from vertically central parts of the base plate 29 and a body 31 protruding toward both upper and lower sides from the front end of the projection 30. The projection 30 and the body 31 are formed to be substantially T-shaped in a side view. Further, the projections 30 of the two contact stop walls 21 are coupled integrally via an unillustrated beam extending in the lateral direction.

The contact stop walls 21 have such rigidity as not to be deflected and deformed easily and are made substantially impossible to deflect and deform by having deflection and deformation restricted. The front end surfaces of the bodies 31 are arranged at positions behind each projection of the resiliently holding portion 28 in the front-rear direction and overlapping with the curved portions 24 of the first resilient pieces 19 in the front-rear direction. As shown in FIG. 4, the front end surfaces of the bodies 31 are arranged along the vertical direction and the connector housing 10 accommodated into the holding space 27 can be stopped in contact with these front end surfaces.

As shown in FIG. 4, the mounting member 16 is formed with an open free space 32 communicating with the holding space 27 behind the bodies 31. Later-described engaging portions 37 of the connector housing 10 are freely displaceable in the free space 32 in a free state where the engaging portions 37 are not engaged with the mounting member 16.

Figure 2:
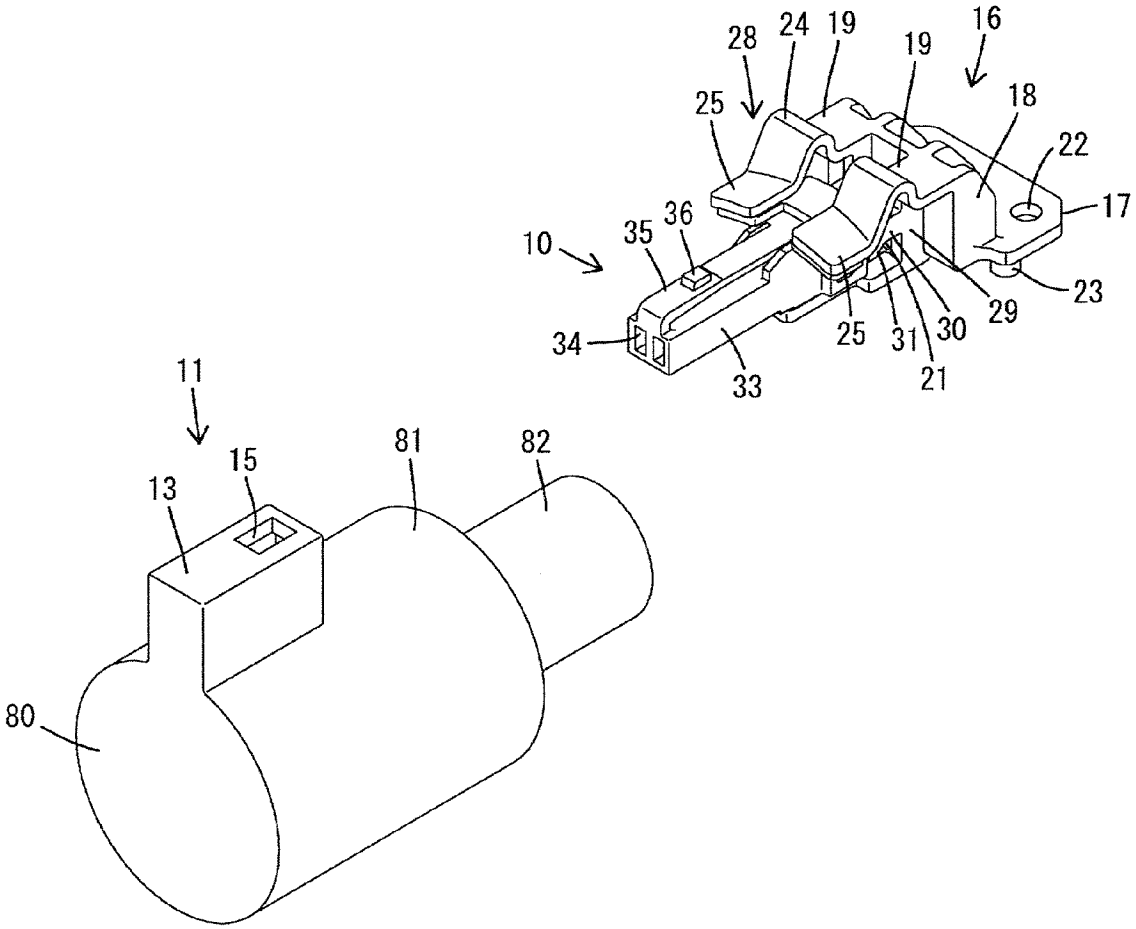
FIG. 2 is a perspective view showing a state where the connector housing is assembled at a temporary holding position with respect to the mounting member.

The connector housing 10 is displaceable from a temporary holding position (see FIGS. 2 to 5) to a retracted position (see FIG. 6). The connector housing 10 that is in the temporary holding position is held in a waiting state in the mounting member 16 and a rear end part (engaging portions 37 and both wings 40 to be described later) is accommodated in the holding space 27, as shown in FIG. 2. The connector housing 10 that is in the retracted position (see FIG. 6) has the rear end part accommodated in the free space 32.

Specifically, the connector housing 10 is made of synthetic resin and includes a housing body 33 in the form of a block long and narrow in the front-rear direction, as shown in FIG. 1. Cavities 34 are provided in the housing body 33, and an unillustrated terminal fitting is inserted and accommodated into each cavity 34 from behind. The female terminal fitting is connected to an end part of an unillustrated wire, and the connected wire is pulled out from the rear surface of the housing body 33 and accommodated into the harness accommodating member.

A lock arm 35 is provided on the upper surface of the housing body 33. The lock arm 35 is cantilevered rearward from the front end of the upper surface of the housing body 33 and is deflectable and deformable in the vertical direction. The lock portion 36 projects on the upper surface of the lock arm 35.

Figure 5:
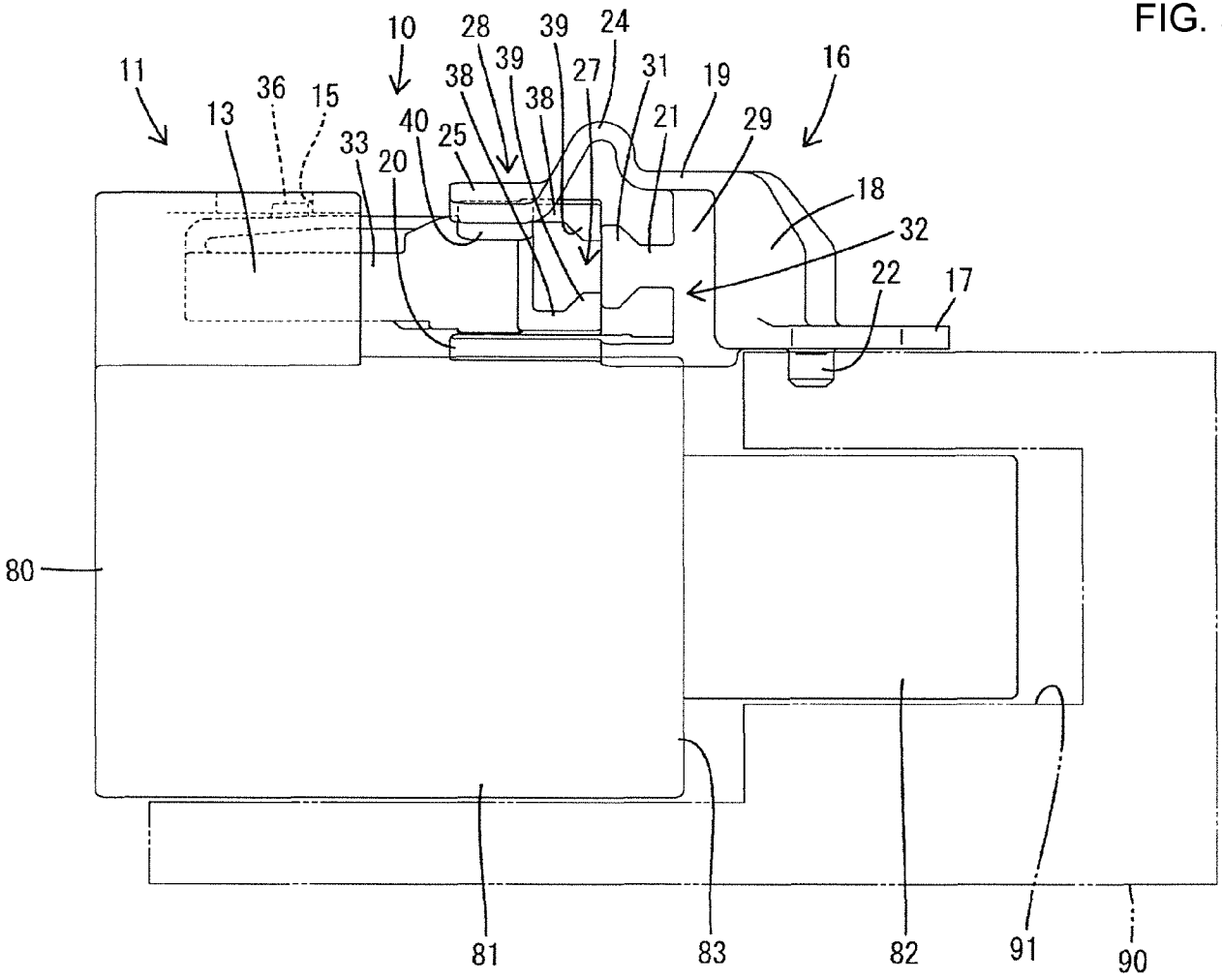
FIG. 5 is a side view corresponding to the state of FIG. 3.

As shown in FIG. 1, two engaging portions 37 are provided on the rear end of the housing body 33 and project rearward from both upper and lower ends. Each engaging portion 37 includes a base 38 in the form of a plate extending along the lateral direction and is made substantially impossible to deflect and deform by having deflection and deformation restricted. As shown in FIG. 5, claw-like contacting portions 39 are provided on rear parts of the bases 38 and projecting in toward each other. Each contacting portion 39 is in the form of a rib extending in the width direction along the rear end of the base 38. The rear end surface of the contacting portion 39 is arranged along the vertical direction and can come into contact with the front end surface of the body 31 of the contact stop wall 21.

As shown in FIG. 1, two wing portions 40 are provided on the upper end of a rear end side of the housing body 33 and protrude toward both left and right sides. The wings 40 are in the form of plates, inclined down toward opposite sides from a laterally central part and are curved arcuately (see FIG. 7). The upper surfaces (outer surfaces) of the wings 40 are slidable in the lateral direction (including a circumferential direction) with respect to the lower surfaces of the contact portions 25 of the first resilient pieces 19 and include concave spherical recesses 41 into which the projections 26 of the contact portions 25 are fittable. An unillustrated recess also is provided on the lower surface of the rear end part of the housing body 33 to correspond to the projection 26 of the second resilient piece 20.

Further, as shown in FIG. 1, the wings 40 and the base 38 are coupled integrally to surround a rear end part of the lock arm 35 from both lateral and rear sides. An insertion hole 42 substantially rectangular in a plan view is open between coupled parts of the wings 40 and the base 38 and the rear end of the lock arm 35, and the respective wires pulled out from the housing body 33 are guided into the harness accommodating member through the insertion hole 42.

Next, functions and effects of the first embodiment configured as described above are described.

As shown in FIGS. 1 and 2, the connector housing 10 is mounted into the holding space 27 of the mounting member 16 from the front. In this case, the connector housing 10 is pushed into the holding space 27 so that both engaging portions 37 and both wings 40 widen a spacing between the first resilient pieces 19 and the second resilient piece 20, and resiliently held by the resiliently holding portion 28. The wings 40 face the lower surfaces of the first resilient pieces 19, the recesses 41 of the wings 40 are fit to the projections of the first resilient pieces 19, and the second projection 26 of the second resilient piece 20 is fit into the recess of the housing body 33. Thus, the connector housing 10 is supported at three points while being substantially positioned in the resiliently holding portion 28 at the temporary holding position. Further, at the temporary holding position, the rear end surfaces of the contacting portions 39 of the engaging portions 37 are stopped in contact with the front end surfaces of the bodies 31 of the contact stop walls 21, as shown in FIG. 4, to prevent a rearward movement of the connector housing 10 toward the retracted position.

Subsequently, the valve portion 82 of the solenoid 80 is inserted into the solenoid mounting portion 91. At this time, if a positional relationship is set such that the valve portion 82 of the solenoid 80 is opposed to the solenoid mounting portion 91 and the receptacle 13 of the mating connector housing 11 is opposed to the housing body 33 of the connector housing 10, the receptacle 13 allows the housing body 33 to be fit therein, the connector housings 10, 11 are connected properly and the male and female terminal fittings are connected properly. Note that when the connector housing 10 is at the temporary holding position, even if the connector housings 10, 11 are connected properly, as shown in FIG. 5, the solenoid 80 has not yet reached a state properly inserted in the solenoid mounting portion 91.

Further, in a final stage of the process of connecting the connector housing 10, a connecting operation of the male and female terminal fittings proceeds and the lock arm 35 is deflected and deformed by interfering with the receptacle 13. Thus, connection resistance increases and a pushing force for moving the connector housing 10 rearward acts on the connector housing 10. In that respect, according to the first embodiment, a state where the contacting portions 39 of the engaging portions 37 are stopped in contact with the bodies 31 of the contact stop walls 21 is maintained reliably. Thus, situations such as a rearward movement of the connector housing 10 at the temporary holding position by being pushed in a state incompletely connected to the mating connector housing 11 can be avoided.

On the other hand, even if the connector housings 10, 11 are not opposed to each other, e.g. the mating connector housing 11 is displaced in a circumferential direction (arrow direction X of FIG. 7) from an opposing position about an axis of the solenoid 80, the front end part of the connector housing 10 is guided into the receptacle 13 of the mating connector housing 11 and lightly connected. Thus, the connector housing 10 is guided to a proper connection position to the mating connector housing 11, such as by sliding movements of the wings 40 on the first resilient pieces 19 while being accompanied by the deflection of the first resilient pieces 19 and the second resilient piece 20. Therefore, a displacement at the start of connection of the connector housings 10, 11 is properly absorbed by the resiliently holding portion 28, and a state where the connector housings 10, 11 are connected properly can be guaranteed.

Subsequently, the connector housings 10, 11 in the connected state are displaced in the circumferential direction (arrow direction X of FIG. 7) by rotating the solenoid 80 about the axis with respect to the solenoid mounting portion 91. Then, each projection comes out of each recess, the first resilient pieces 19 are deflected and deformed and, along with that, the wings 40 slide on the first resilient pieces 19 and the contacting portions 39 of the engaging portions 37 are separated from the bodies 31 of the contact stop walls 21 so that a contact stop state is released. In this way, a displacement of the connector housings 10, 11 in the connected state to the retracted position is allowed.

Subsequently, the solenoid 80 is inserted to a proper insertion depth into the solenoid mounting portion 91. Then, the connector housing 10 reaches the retracted position and the engaging portions 37 of the connector housing 10 are retracted into the free space 32, as shown in FIG. 6.

Further, the solenoid 80 is rotated about the axis with respect to the solenoid mounting portion 91, an unillustrated fixing portion (e.g. fixing hole or the like) of the solenoid 80 and an unillustrated fixing portion (e.g. fixing hole or the like) of the valve body 90 are aligned with each other and a fixing means (e.g. pin member penetrating through the both fixing holes) are locked to the fixing portions, thereby fixing the solenoid 80 to the valve body 90. While the solenoid 80 rotates about the axis in this way, the mating connector housing 11 provided on the solenoid 80 is displaced in the circumferential direction about the axial center of the solenoid 80 and, simultaneously, the connector housing 10 connected to the mating connector housing 11 also is displaced in the circumferential direction. At this time, the interference of the contact stop walls 21 with the engaging portions 37 is avoided by inserting parts substantially T-shaped in a side view and composed of the projections 30 and the bodies 31 in the contact stop walls 21 into spaces 44 (see FIG. 6) between the bases 38 and the contacting portions 39 in the engaging portions 37 and allowing them to escape. Thus, the connector housing 10 can be displaced freely according to a movement of the side of the mating connector housing 11 in the free space 32.

As described above, according to the first embodiment, a rearward movement of the connector housing 10 is restricted by the mounting member 16 when the connector housing 10 is connected to the mating connector housing 11 from the front at the temporary holding position. Thus, it can be guaranteed that the connector housings 10, 11 reach the properly connected state. Particularly, the connector housing 10 is connected properly to the mating connector housing 11 while being stopped in contact with the contact stop walls 21 at the temporary holding position and, thereafter, the connector housing 10 is rotated so that the contact stop state between the connector housing 10 and the contact stop walls 21 is released and a displacement of the connector housing 10 to the retracted position is enabled. Thus, it can be reliably guaranteed that the connector housings 10, 11 are in the properly connected state when a rotational operation is performed.

Further, after the connector housings 10, 11 are connected properly, the connector housing 10 having reached the retracted position is movable integrally with the mating connector housing 11 according to a movement of the side of the mating connector housing 11 without being held by the mounting member 16. Thus, when the side of the mating connector housing 11 rotates according to a rotational movement of the solenoid 80, the connector housing 10 is rotatable together with the mating connector housing 11.

Further, since the mounting member 16 includes the resiliently holding portion 28 for holding the connector housing 10 displaceably in the lateral direction and the circumferential direction at the temporary holding position, the connector housing 10 is center-aligned by the resiliently holding portion 28 at the temporary holding position and is concentrically connectable to the mating connector housing 11.

FIGS. 8 to 14 show a second embodiment of the invention. The second embodiment differs from the first embodiment in a configuration for displacing a connector housing 10A to a retracted position. Specifically, the second embodiment differs from the first embodiment in the form of each of a mating connector housing 11A, a front side of a mounting member 16A and a front side of the connector housing 11A. Of course, since a basic structure of the second embodiment is similar to that of the first embodiment, structures similar to or equivalent to those of the first embodiment are denoted by the same reference signs and not repeatedly described.

Figure 8:
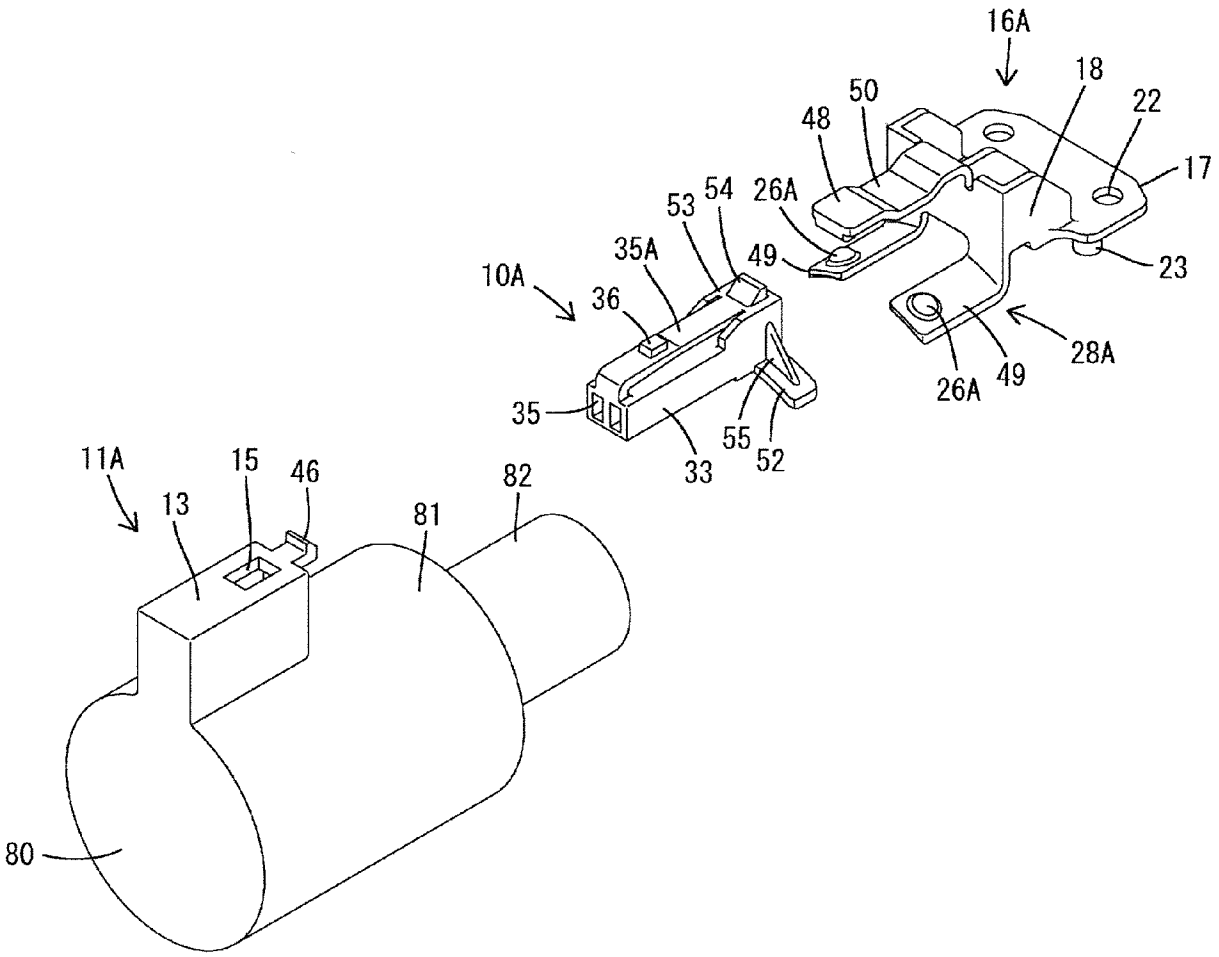
FIG. 8 is perspective view showing a state where a mating connector housing provided on a solenoid, a connector housing and a mounting member are separated in a second embodiment of the present invention.
Figure 11:
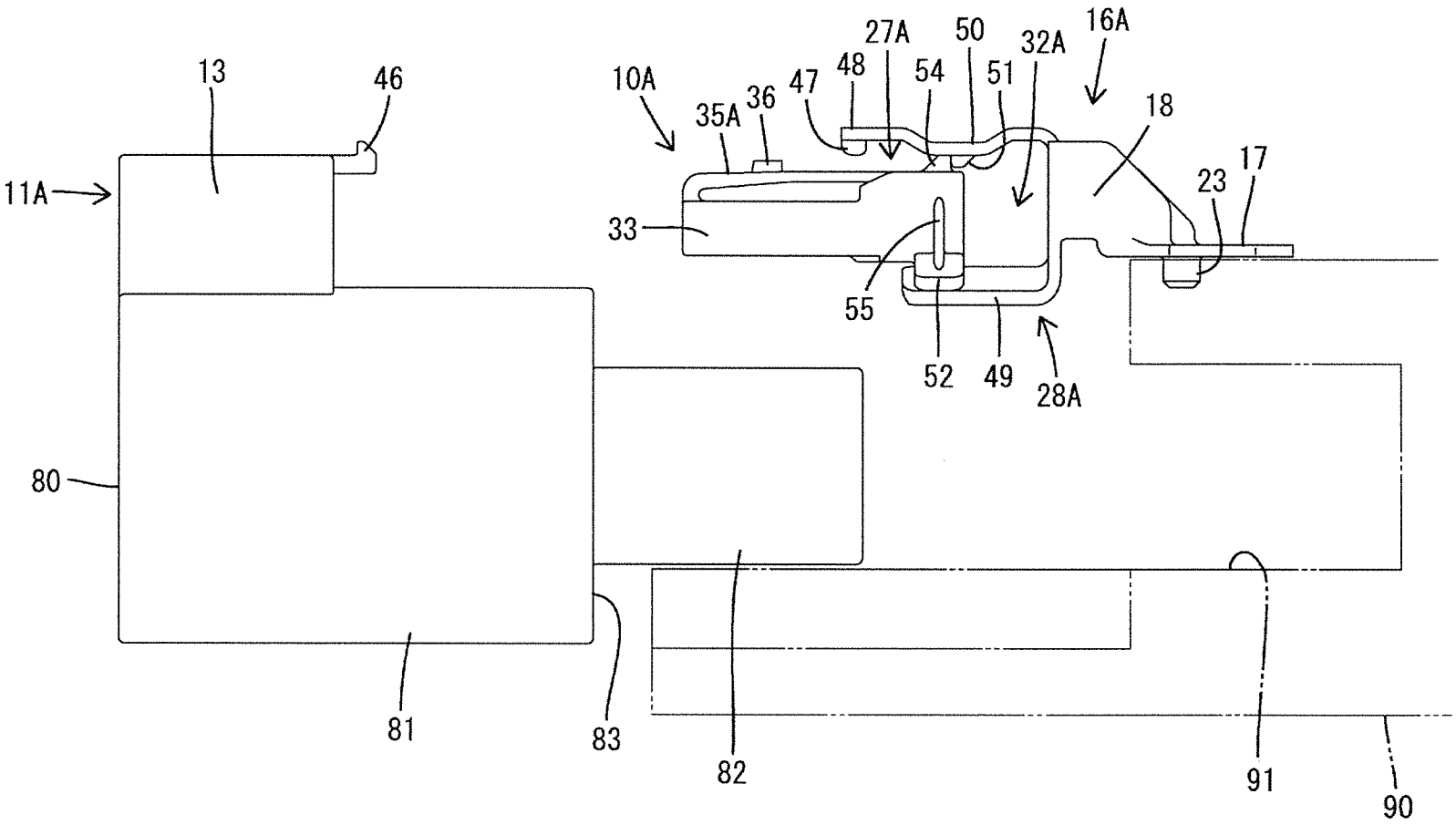
FIG. 11 is a side view corresponding to the state of FIG. 9.
Figure 12:
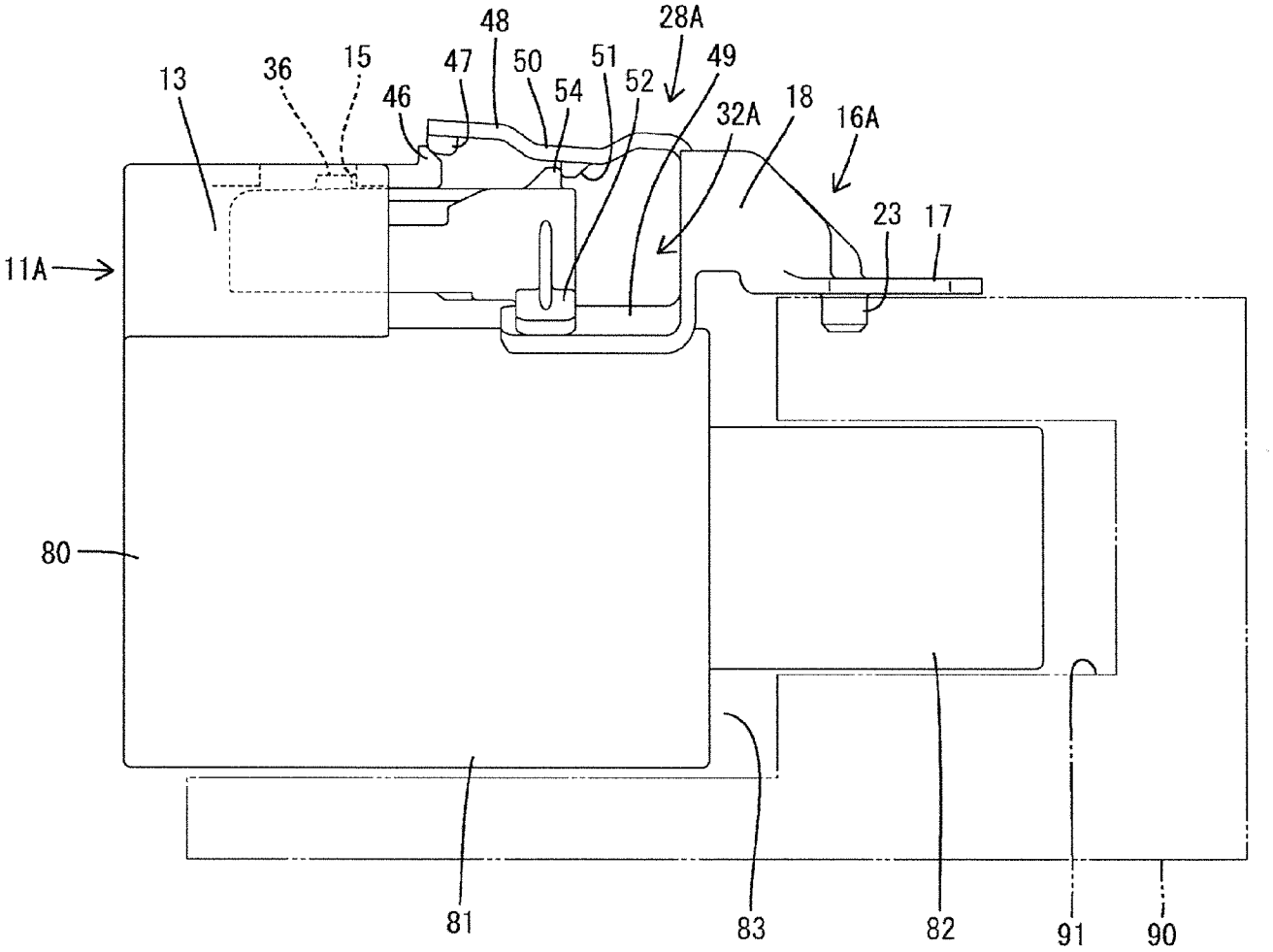
FIG. 12 is a side view showing a state immediately before a pressing portion presses a releasing portion to lift an arm portion and a contact stop state between a contact stop portion and an interfering portion is released.

As shown in FIG. 8, a claw-like pressing portion 46 is provided on a front end part of the mating connector housing 11A and projects forward and up from the front end of a receptacle 13. As shown in FIG. 11, the front surface of the pressing portion 46 is inclined and tapered toward a rear side. As shown in FIG. 12, the pressing portion 46 can press a later-described releasing portion 47 of the mounting member 16A when both connector housings 10A, 11A are connected properly.

As shown in FIG. 8, the mounting member 16A includes an arm 48 cantilevered forward from a laterally central part of the upper end of a rising portion 18 and two resilient pieces 49 projecting down from both left and right sides of the lower end of the rising portion 18 and then projecting forward. The mounting member 16A of the second embodiment has nothing equivalent to the contact stop walls 21 of the first embodiment. Note that, in the following description, the arm 48 and the resilient pieces 49 collectively are called a resiliently holding portion 28A.

Figure 14:
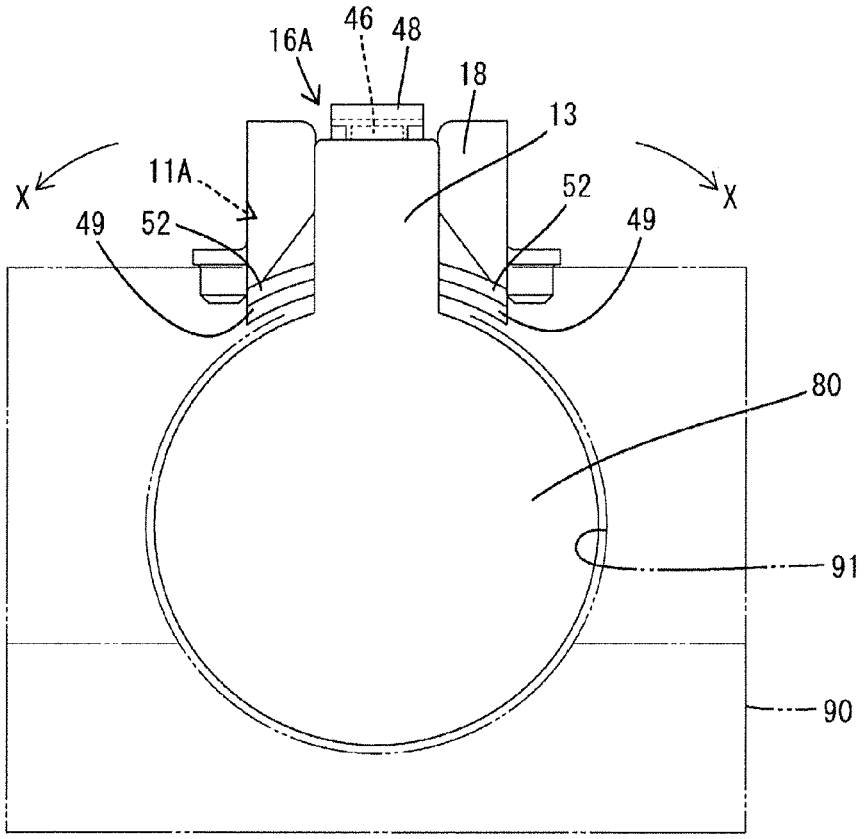
FIG. 14 is a front view showing a state where the both connector housings are properly connected when viewed from the side of the mating connector housing.

The resilient pieces 49 are inclined down from a laterally central part toward opposite sides in a front view and, specifically, are formed to extend along concentric arc virtual lines centered on an axial center of a solenoid 80 when the connector housings 10A, 11A are connected (see FIG. 14). The lower surfaces (outer surfaces) of the resilient pieces 49 are arranged along the outer peripheral surface of the solenoid 80 when the connector housings 10A, 11A are connected properly. As shown in FIG. 8, convexly spherical projections 26A are provided to project on the upper surfaces (inner surfaces) of both resilient pieces 49.

As shown in FIGS. 8 and 11, the arm 48 is in the form of a strip plate whose front end is located in front of the front ends of the resilient pieces 49, and is deflectable and deformable in the vertical direction with the upper end of the rising portion 18 as a fulcrum. As shown in FIG. 11, a step 50 is provided at an intermediate position of the arm 48 in the front-rear direction and is recessed down into a substantially U shape in a side view. A claw-like contact stop 51 projects on the lower surface (inner surface) of the step 50. The front surface of the contact stop 51 is arranged along the vertical direction. Further, the releasing portion 47 projects farther forward than the contact stop 51 on the lower surface of the front end of the arm 48. The front surface of the releasing portion 47 is inclined rearwardly in a curved manner.

As shown in FIG. 11, a holding space 27A is formed to be open between the resilient pieces 49 and the arm 48 and between the contact stop 51 and the releasing portion 47 in the front-rear direction. The connector housing 10A resiliently supported by the resilient pieces 49 and the arm 48 is accommodated displaceably into the holding space 27A.

Further, as shown in FIG. 11, a free space 32A communicating with the holding space 27A is open between the resilient pieces 49 and the arm 48 and between the contact stop 51 and the rising portion 18 in the front-rear direction. Later-described engaging wings 52 of the connector housing 10A are arranged freely displaceably in the free space 32A in a free state where the engaging wings 52 are not engaged with the mounting member 16A.

Next, the connector housing 10A is described, centering on points of difference from the first embodiment. As shown in FIG. 8, a lock arm 35A is supported on both sides by being coupled to both front and rear ends of a housing body 33. A stage 53 is raised slightly on a rear end part of the housing body 33. The rear end of the lock arm 35A is coupled integrally to this stage 53. An interfering portion 54 projects on the upper surface of the stage 53. As shown in FIG. 11, the rear surface of the interfering portion 54 is arranged along the vertical direction. A displacement of the connector housing 10A to the retracted position is restricted by stopping the rear surface of the interfering portion 54 in contact with the front surface of the contact stop 51 in the holding space 27A.

As shown in FIG. 8, two engaging wings 52 are provided on a rear end side of the housing body 33 and protrude toward opposite sides from the lower ends of both left and right side surfaces. The engaging wings 52 are in the form of plates inclined down toward both left and right sides and are substantially arcuately arranged in a curved manner (see FIG. 14). The lower surfaces (outer surfaces) of the engaging wings 52 are slidable on the upper surfaces (inner surfaces) of the resilient pieces 49 in the lateral direction (including a circumferential direction) and include unillustrated concavely spherical recesses into which the projections 26A of the resilient pieces 49 are fittable. Further, as shown in FIG. 8, the connector housing 10A is provided with reinforcing walls 55 substantially triangular in a front view from the engaging wing portions 52 to side surfaces of the housing body 33.

Next, functions and effects of the second embodiment are described.

Figure 9:
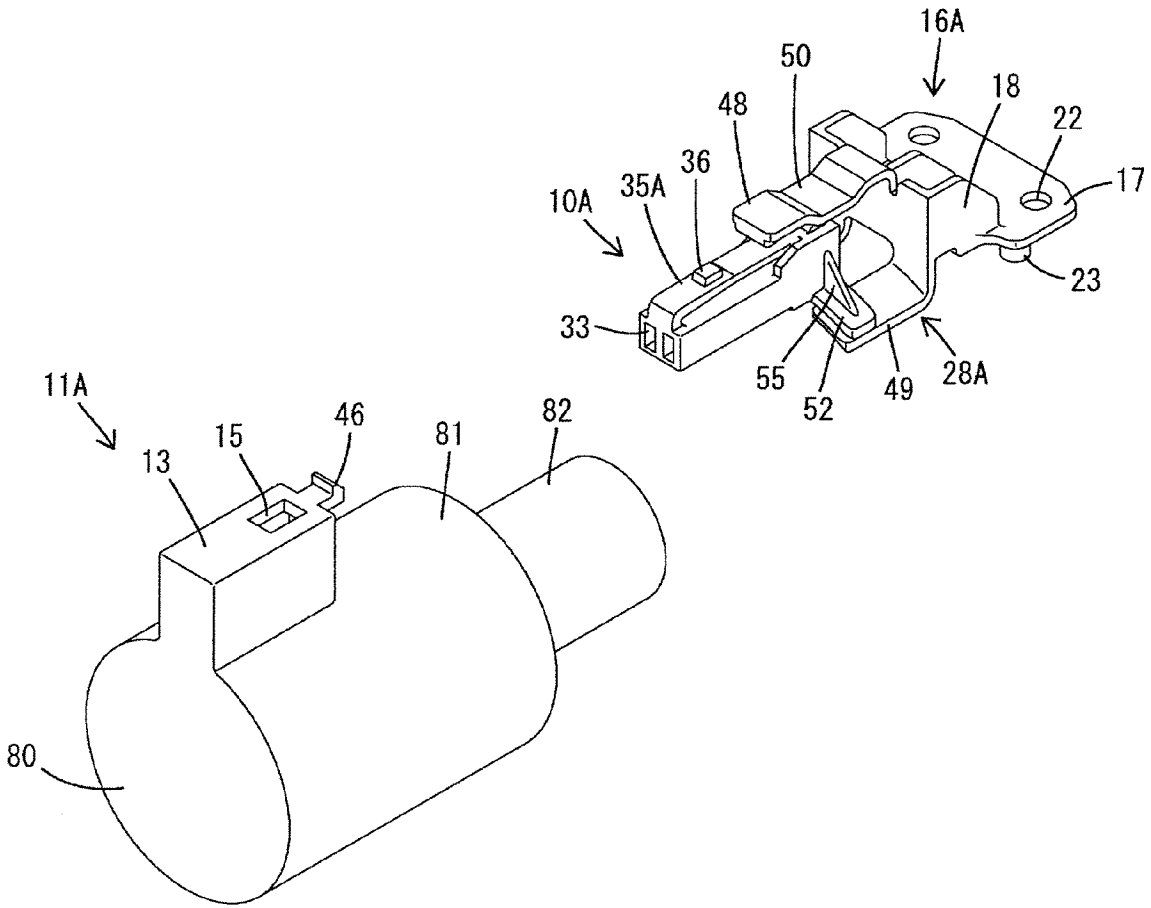
FIG. 9 is a perspective view showing a state where the connector housing is assembled at a temporary holding position with respect to the mounting member.
Figure 10:
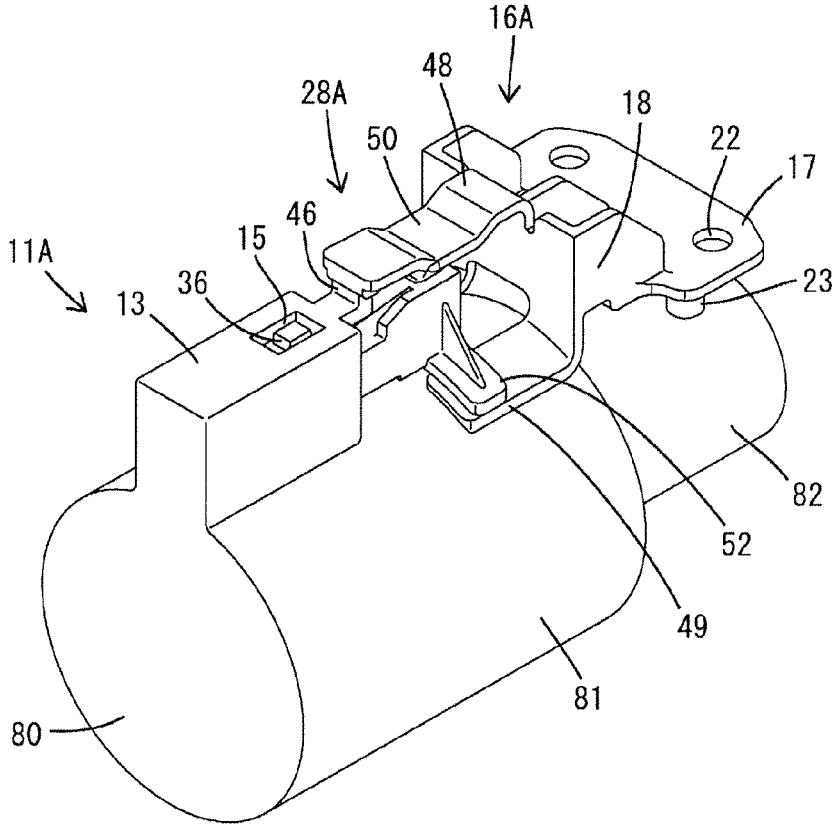
FIG. 10 is a perspective view showing a state where the mating connector housing provided on the solenoid is properly connected to the connector housing.

First, as shown in FIGS. 8 and 9, the connector housing 10A is mounted into the holding space 27A of the mounting member 16A from the front. In this case, as shown in FIG. 11, a rear end part of the connector housing 10A is inserted into the holding space 27A, the rear surface of the interfering portion 54 comes into surface contact with the front surface of the contact stop 51 to restrict a rearward movement of the connector housing 10A and the projections 26A of the resilient pieces 49 are fit into the recesses of the engaging wins 52. Thus, the connector housing 10A is supported in a state substantially positioned by the resiliently holding portion 28A at the temporary holding position. Here, a contact state between the interfering portion 54 and the contact stop 51 is maintained until the connector housings 10, 11 are connected properly.

Subsequently, a valve portion 82 of the solenoid 80 is inserted into a solenoid mounting portion 91. At the same time as or immediately after the connector housings 10A, 11A are connected properly in the process of inserting the valve portion 82 of the solenoid 80 into the solenoid mounting portion 91 as shown in FIG. 12, the pressing portion 46 slides on the front surface of the releasing portion 47 and the arm 48 is lifted resiliently up. In this way, the contact stop 51 moves up together with the arm 48 and is displaced in a direction away from the interfering portion 54 and, finally, the contact stop state between the contact stop 51 and the interfering portion 54 is released. As a result, a rearward movement of the connector housing 10A to the retracted position is allowed.

Figure 13:
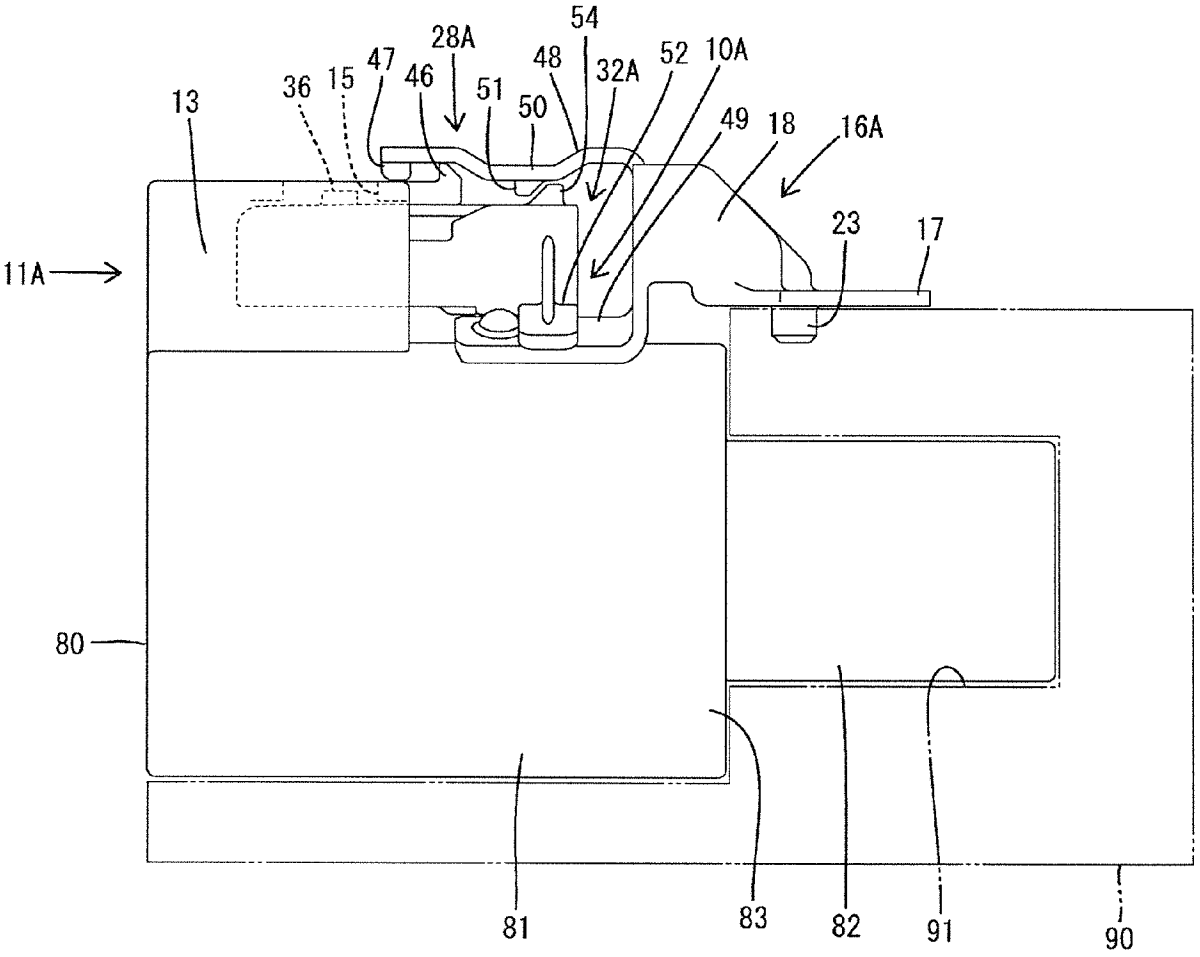
FIG. 13 is a side view showing a state where the connector housing is at a retracted position with respect to the connector housing.

Further, by continuing an operation of inserting the valve portion 82 of the solenoid 80 into the solenoid mounting portion 91 without interruption when the connector housings 10A, 11A are connected properly, a rear part of the connector housing 10A is moved into the free space 32A and the connector housing 10A can reach the retracted position, as shown in FIG. 13. Since locking between the engaging wings 52 and the resilient pieces 49 and between the interfering portion 54 and the contact stop 51 is released in the free space 32A, the connector housing 10A can freely move according to a movement of the side of the mating connector housing 11A. Thus, in fixing the solenoid 80 to a valve body 90, the connector housing 10A can be displaced in the circumferential direction (arrow direction X of FIG. 14) and a fixing operation of the solenoid 80 can be performed without any trouble. This point holds true also in the first embodiment.

According to the second embodiment, the connector housing 10A is connected properly to the mating connector housing 11A with the interfering portion 54 thereof stopped in contact with the contact stop 51 at the temporary holding position and, along with that, the releasing portion 47 is pressed by the pressing portion 46 of the mating connector housing 11A to incline the arm 48, thereby releasing the contact stop state between the contact stop 51 and the interfering portion 54 and making a displacement of the connector housing 10A to the retracted position possible. Thus, it can be guaranteed that the both connector housings 10A, 11A are in the properly connected state and the connector housing 10A can be displaced smoothly from the temporary holding position to the retracted position in linkage with a connecting operation of the connector housings 10A, 11A (also a mounting operation of the solenoid 80).

Other embodiments are briefly described below.

Although the connector housing is held displaceably in the lateral direction at the temporary holding position by the resiliently holding portion in the case of the first and second embodiments, the connector housing may be held at the temporary holding position with displacements restricted unless necessary.

Although a rear part of the free space is partitioned by the rising portion in the case of the first and second embodiments, the rising portion may be omitted and the free space may be open rearward if possible.

The projections are provided on the side of the resiliently holding portion and the recesses are provided on the side of the connector housing in the case of the first and second embodiments. Contrary to this, the recesses may be provided on the side of the resiliently holding portion and the projections may be provided on the side of the connector housing.

The present invention is also applicable in the case of causing a connector housing to follow an operation of a device or component other than solenoids.

LIST OF REFERENCE SIGNS

10, 10A . . . connector housing
11, 11A . . . mating connector housing
16, 16A . . . mounting member
21 . . . contact stop
27, 27A . . . holding space
28, 28A . . . resiliently holding portion
32, 32A . . . free space
37 . . . engaging portion
47 . . . releasing portion
48 . . . arm
51 . . . contact stop
80 . . . solenoid

The invention claimed is:

1. A connector, comprising:

a connector housing to which a mating connector housing is connectable from front; and a mounting member into which the connector housing is mountable;

wherein the connector housing is displaceable, with respect to the mounting member, to a temporary holding position where the connector housing is held in the mounting member with a rearward movement restricted and a retracted position to which the connector housing is moved rearward together with the mating connector housing by being released from a holding state at the temporary holding position after the connector housing is properly connected to the mating connector housing and where the connector housing is movable integrally with the mating connector housing according to a movement of the side of the mating connector housing without being held by the mounting member.

2. The connector of claim 1, wherein the mounting member includes a resiliently holding portion configured to hold the connector housing at the temporary holding position displaceably in a direction perpendicular to a front-rear direction.

3. The connector of claim 2, wherein the mounting member includes a contact stop wall configured to restrict a rearward movement of the connector housing by stopping the connector housing in contact therewith until the connector housing is properly connected to the mating connector housing and release a contact stop state between the connector housing and the contact stop wall by a rotational operation after the connector housing is properly connected to the mating connector housing.

4. The connector of claim 2, wherein the mounting member includes an arm projecting forward and the arm includes a contact stop configured to restrict a rearward movement of the connector housing by stopping the connector housing in contact therewith until the connector housing is properly connected to the mating connector housing, and a releasing portion located in front of the contact stop and configured to be pressed by the mating connector housing when the connector housing is properly connected to the mating connector housing, thereby inclining the arm to release a contact stop state between the contact stop and the connector housing.

5. The connector of claim 1, wherein the mounting member includes a contact stop wall configured to restrict a rearward movement of the connector housing by stopping the connector housing in contact therewith until the connector housing is properly connected to the mating connector housing and release a contact stop state between the connector housing and the contact stop wall by a rotational operation after the connector housing is properly connected to the mating connector housing.

6. The connector of claim 1, wherein the mounting member includes an arm projecting forward and the arm includes a contact stop configured to restrict a rearward movement of the connector housing by stopping the connector housing in contact therewith until the connector housing is properly connected to the mating connector housing, and a releasing portion located in front of the contact stop and configured to be pressed by the mating connector housing when the connector housing is properly connected to the mating connector housing, thereby inclining the arm to release a contact stop state between the contact stop and the connector housing.

* * * * *